US008304154B2

(12) United States Patent
Kobayashi et al.

(10) Patent No.: US 8,304,154 B2
(45) Date of Patent: Nov. 6, 2012

(54) PARTICLE DISPERSION LIQUID, PARTICLES, PARTICLE DISPERSION LIQUID CARTRIDGE, PROCESS CARTRIDGE, IMAGE FORMING APPARATUS, AND IMAGE FORMING METHOD

(75) Inventors: Takako Kobayashi, Kanagawa (JP); Yoshihiro Inaba, Kanagawa (JP); Ryosaku Igarashi, Kanagawa (JP); Masahiro Takamatsu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 472 days.

(21) Appl. No.: 12/552,764

(22) Filed: Sep. 2, 2009

(65) Prior Publication Data

US 2010/0248111 A1 Sep. 30, 2010

(30) Foreign Application Priority Data

Mar. 27, 2009 (JP) ..... 2009-079728

(51) Int. Cl.
*G03G 9/00* (2006.01)

(52) U.S. Cl. ..... 430/105; 430/45.2; 430/45.4; 430/115

(58) Field of Classification Search ..... 430/45.2, 430/105, 112, 45.4, 115
See application file for complete search history.

(56) References Cited

U.S. PATENT DOCUMENTS

| | | | | |
|---|---|---|---|---|
| 2002/0077384 | A1 | 6/2002 | Sano et al. | |
| 2003/0236321 | A1 | 12/2003 | Sano et al. | |
| 2007/0087281 | A1* | 4/2007 | Patel et al. | 430/110.2 |
| 2008/0035019 | A1* | 2/2008 | Kobayashi et al. | 106/31.92 |

FOREIGN PATENT DOCUMENTS

| | | |
|---|---|---|
| JP | A-3-29961 | 2/1991 |
| JP | A-3-59678 | 3/1991 |
| JP | A-2002-30237 | 1/2002 |
| JP | A-2003-342507 | 12/2003 |
| JP | A-2006-249354 | 9/2006 |
| JP | A-2008-45063 | 2/2008 |
| JP | A-2008-63552 | 3/2008 |

OTHER PUBLICATIONS

Office Action issued in Japanese Application No. 2009-079728 dated Feb. 8, 2011 (with translation).

* cited by examiner

*Primary Examiner* — Thorl Chea
(74) *Attorney, Agent, or Firm* — Oliff & Berridge, PLC

(57) ABSTRACT

The present invention provides a particle dispersion liquid including (meth)acrylic resin-containing hydrophobic particles, an acetylene glycol surfactant adsorbed to the hydrophobic particles, and water; the particle size, in a state of being swollen due to absorbing water until saturation, of the hydrophobic particles to which the acetylene glycol surfactant has been adsorbed being 1.1 to 2 times as large as the particle size of the hydrophobic particles in a dried state.

19 Claims, 2 Drawing Sheets

PARTICLE DISPERSION LIQUID, PARTICLES, PARTICLE DISPERSION LIQUID CARTRIDGE, PROCESS CARTRIDGE, IMAGE FORMING APPARATUS, AND IMAGE FORMING METHOD

CROSS-REFERENCE TO RELATED APPLICATION

This application is based on and claims priority under 35 USC 119 from Japanese Patent Application No. 2009-079728, filed on Mar. 27, 2009.

BACKGROUND

1. Technical Field

The present invention relates to a particle dispersion liquid, particles, a particle dispersion liquid cartridge, a process cartridge, an image forming apparatus, and an image forming method.

2. Related Art

As an image forming method using a magnetic material, there is conventionally technology called magnetography wherein a magnetic head is operated to form a magnetic latent image on a magnetic recording medium having a magnetic material on the surface thereof and this magnetic latent image is developed with a magnetic toner, then transferred thermally or electrostatically onto a transfer medium, then fixed and printed.

SUMMARY

According to an aspect of the invention, there is provided a particle dispersion liquid including:

(meth)acrylic resin-containing hydrophobic particles, an acetylene glycol surfactant adsorbed to the hydrophobic particles, and water; the particle size, in a state of being swollen due to absorbing water until saturation, of the hydrophobic particles to which the acetylene glycol surfactant has been adsorbed being about 1.1 to about 2 times as large as the particle size thereof in a dried state.

BRIEF DESCRIPTION OF THE DRAWINGS

Exemplary embodiments of the invention will be described in detail based on the following figures, wherein.

DETAILED DESCRIPTION

Figure 1:
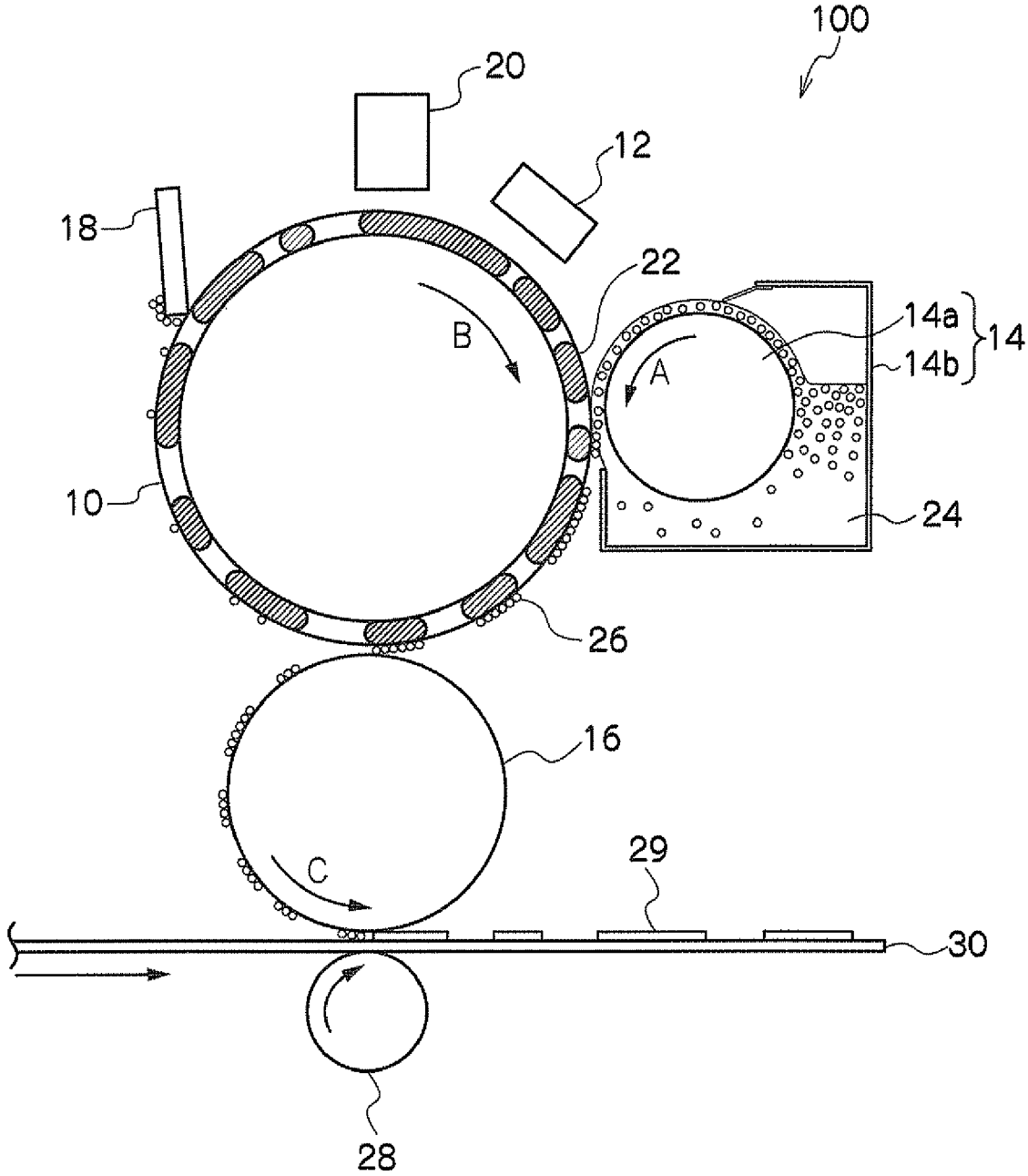
FIG. 1 is a skeleton framework showing one example of the image forming apparatus in the exemplary embodiment of the invention.

Hereinafter, exemplary embodiments of the present invention will be described.

The particle dispersion liquid in the exemplary embodiment of the invention includes (meth)acrylic resin-containing hydrophobic particles, an acetylene glycol surfactant adsorbed to the hydrophobic particles, and water, wherein the particle size, in a state of being swollen due to absorbing water until saturation, of the hydrophobic particles to which the acetylene glycol surfactant has been adsorbed being 1.1 or about 1.1 to 2 or about 2 times as large as the particle size thereof in a dried state.

The particles in the exemplary embodiment of the invention include at least a (meth)acrylic resin and an acetylene glycol surfactant, wherein the particle size thereof in a state of being swollen due to absorbing water until saturation is 1.1 or about 1.1 to 2 or about 2 times as large as the particle size thereof in a dried state.

The particle dispersion liquid in the exemplary embodiment of the invention, as described above, contains hydrophobic particles swollen in a surfactant-containing dispersion medium (dispersion medium containing at least water), wherein an acetylene glycol surfactant is contained as the surfactant contained in the particle dispersion liquid.

When water in the dispersing medium in the particle dispersion liquid is dried, the surfactant is not evaporated, so that the acetylene glycol surfactant is contained in the inside and/or surfaces of the particles to constitute composite particles. These composite particles (the particles in the exemplary embodiment of the invention) have a property of being swollen due to incorporating water, and the particle size thereof in a state of being swollen due to absorbing water until saturation is 1.1 or about 1.1 to 2 or about 2 times as large as the particle size thereof in a dried state.

Because the particles are swollen due to incorporating water, the dispersibility of the particles in a water-containing dispersion medium is improved.

The mechanism of swelling of the particles is not evident, and it is estimated that the hydrophobic moiety of the acetylene glycol surfactant is adsorbed strongly onto polymer chains of the hydrophobic particles, thereby softening and hydrophilizing the polymer chains to allow the particles to be swollen due to incorporating water.

The particle dispersion liquid in the exemplary embodiment of the invention is used preferably as a developer for forming an image.

Generally, (meth)acrylic resin-containing polymer particles are used by thermally fused and melted thereby fixating them on a recording medium (paper), and so high energy is necessary for fixing. In the particle dispersion liquid in the exemplary embodiment of the invention, however, the particles have been swollen due to absorbing water and thus can be fixed with lower energy than conventional. The fixing mechanism is not evident, and it is estimated that by the presence of a dispersion medium (water) in the swollen particles, the intermolecular interaction is weakened thereby decreasing the apparent softening point, and thus the particles are broken easily with lower energy and fixed on a recording medium.

By incorporating a magnetic material into the hydrophobic particles, the particle dispersion liquid in the exemplary embodiment of the invention can be used preferably as a developer for liquid magnetography. Liquid magnetography is an image forming method wherein image display particles (toner) containing magnetic particles are used in development of a magnetic latent image.

The particles in the exemplary embodiment of the invention are dispersed in a dispersion medium containing at least water, thereby giving the particle dispersion liquid in the exemplary embodiment of the invention which can be used preferably as a developer for forming an image by liquid magnetography etc. as described above.

-Ratio of Particle Size in Swollen State to Particle Size in Dried State-

In the particle dispersion liquid in the exemplary embodiment of the invention as described above, the particle size, in a state of being swollen due to absorbing water until saturation, of the hydrophobic particles to which the acetylene glycol surfactant was adsorbed is 11.1 or about 1.1 to 2 or about 2 times as large as the particle size thereof in a dried state. When this ratio is less than 1.1, the particles are not in a sufficiently swollen state, thus making fixation with low energy difficult. When the ratio is more than 2, the particles cannot sufficiently attain strength and may thus be finely divided in the liquid.

The ratio of the particle size in the swollen state to that in the dried state is calculated by a method described below, and the particle size ratios shown in this specification are calculated by this method. The particle size, whether the particles are in a swollen or dried state, refers to the primary particle size thereof.

[Method of Measuring the Particle Size in Dried State/Microscopy]

In the case of the particle dispersion liquid in the exemplary embodiment of the invention, the particle size thereof is measured when the water content is reduced to 5% by weight or less by evaporating the water-containing dispersion medium. In the case of the particles in the exemplary embodiment of the invention, the particle size thereof is also measured when the water content is reduced to 5% by weight or less.

The dried particles are photographed under a scanning electron microscope (SEM), and the particle sizes of 100 particles selected at random therefrom are measured respectively, and their total is divided by the number of the particles, to determine the number-average primary particle size.

<Method of Measuring the Particle Size in Swollen State/Coulter Method>

In the case of the particle dispersion liquid in the exemplary embodiment of the invention, the particle dispersion liquid is measured as it is. In the case of the particles in the exemplary embodiment of the invention, on the other hand, the particles are measured after they are dispersed in water to absorb water until saturation.

0.1 ml of the dispersion containing the swollen particles is taken, then dispersed in about 100 ml of a measuring liquid ISOTON-II (manufactured by Beckman Coulter) and measured for the number-average primary particle size with Coulter Counter Multisizer 3 (manufactured by Beckman Coulter).

The particle size distribution of the particles having a particle size in the range of 1 μm to 30 μm is measured using an aperture having an aperture diameter of 50 μm, wherein the number of the particles to be measured is 10000. A cumulative number distribution curve is drawn from the side of the smaller particle size for each particle size range (channel) as a result of division of the particle size distribution, and the particle diameter providing 50% cumulative is defined as the number-average primary particle size D50p.

Then, the number-average primary particle size in a swollen state is divided by the number-average primary particle size thereof in a dried state to determine the degree of swelling.

Hereinafter the constitutions of the particle dispersion liquid and particles in the exemplary embodiment of the invention will be described in detail.

<Particle Dispersion Liquid>

(Hydrophobic Particles)

The hydrophobic particles contained in the particle dispersion liquid in the exemplary embodiment of the invention are constituted by incorporating at least (meth)acrylic resin as a polymer compound and further incorporating a magnetic material and a colorant. The hydrophobic particles may have external additive particles added externally thereto (that is, external additive particles are adhered to the hydrophobic particles).

-Polymer Compound-

At least a (meth)acrylic resin prepared by polymerizing (meth)acrylate monomers is used as the polymer compound Specific examples of the polymer compound used herein include a copolymer resin consisting of styrene and (meth) acrylate (that is, a styrene-(meth)acrylic resin), a ternary copolymer consisting of styrene, (meth)acrylate ester and another vinyl monomer, a copolymer resin consisting of ethylene and (meth)acrylate ester(that is, an ethylene-(meth) acrylic resin), a poly(meth)acrylic resin (homopolymer resin), and mixtures thereof.

The (meth)acrylate monomer is preferably a (meth)acrylate ester whose alcohol residue is a substituted or unsubstituted alkyl group having 1 to 18 carbon atoms, wherein the alkyl group is for example a methyl group, an ethyl group, an n-propyl group, an isopropyl group, an n-butyl group, a t-butyl group, a pentyl group, an isopentyl group, a neopentyl group, a hexyl group, a heptyl group, an n-octyl group, a nonyl group, a decyl group, an undecyl group, or a dodecyl group. The alcohol residue includes not only the alkyl group but also a benzyl group, a hydroxyethyl group, the hydroxyethyl group whose hydroxyl group is protected with a hydrophobic protecting group (for example, dihydropyran), a polyoxyethylene group.

In consideration of the dispersibility of the hydrophobic particles in a dispersion medium, the hydrophobic particles preferably uses, as the polymer compound, a polymer containing hydroxyethyl methacrylate, and the (meth)acrylate polymer is preferably further modified with (poly)ethylene glycol.

The styrene monomer is preferably a vinyl group-containing monomer having a substituted or unsubstituted aryl group having 6 to 12 carbon atoms. The aryl group includes, for example, a phenyl group, a naphthyl group, a tolyl group, and a p-n-octyloxyphenyl group, among which a phenyl group is preferable.

Substituents on the alkyl group of the (meth)acrylate monomer and on the aryl group of the styrene monomer include an alkyl group, an alkoxy group, a halogen atom, an aryl group etc.

The alkyl group includes those groups illustrated above as the alkyl group. The alkoxy group includes, for example, a methoxy group, an ethoxy group, a propoxy group, a butoxy group etc., among which a methoxy group and an ethoxy group are preferable. The halogen atom includes a fluorine atom, a chlorine atom, a bromine atom, and an iodine atom, among which a bromine atom and a chlorine atom are preferable. The aryl group includes those illustrated above as the aryl group.

When both the (meth)acrylate monomer and styrene monomer are used as the monomers in the polymer compound, the content of the (meth)acrylate monomer to the styrene monomer in their mixture, in terms of molar ratio ((meth)acrylate monomer/styrene monomer), is preferably in the range of 95/10 to 5/95, more preferably in the range of 90/10 to 10/90.

The polymer compound is desirably one having at least one group selected from a hydroxyl group, a carboxyl group or an alkyl ester group. The polymer compound can have the above functional group by selecting the monomers constituting the polymer compound described above.

The monomer having a hydroxyl group includes, for example, 2-hydroxyethyl (meth)acrylate, 2-hydroxypropyl (meth)acrylate, 3-hydroxypropyl(meth)acrylate, glycerin di(meth)acrylate, 1,6-bis(3-acryloxy-2-hydroxypropyl)-hexyl ether, pentaerythritol tri(meth)acrylate, tris-(2-hydroxyethyl)isocyanuric acid ester (meth)acrylate, and polyethylene glycol(meth)acrylate.

The term "(meth)acrylate" is an expression referring to both acrylate and methacrylate (this applies hereinafter).

The monomer having a carboxyl group includes, for example, acrylic acid, methacrylic acid, methacryloyloxyethyl monophthalate, methacryloyloxyethyl monohexahydrophthalate, methacryloyloxyethyl monomaleate, and methacryloyloxyethyl monosuccinate.

The presence of the functional groups can be confirmed by measuring an infrared absorption spectrum of the hydrophobic particles, but this measurement can be influenced by the magnetic powder etc., and thus the following method is preferably used.

That is, the hydroxyl groups and carboxyl group in the hydrophobic particles are varied depending on the magnetic material and thus it is desirable that the hydroxyl groups etc. in the polymer compound be confirmed by determining the amount of the hydroxy groups and carboxyl groups in the polymer component excluding the magnetic material.

When the polymer compound has hydroxyl groups only among the above groups, the amount of the hydroxy groups is preferably in the range of 0.1 to 5.0 mmol/g, more preferably in the range of 0.2 to 4.0 mmol/g, even more preferably 0.3 to 3.0 mmol/g.

When the polymer compound has carboxyl groups, the amount of the carboxyl groups is preferably in the range of 0.005 to 0.5 mmol/g, more preferably in the range of 0.008 to 0.3 mmol/g, even more preferably 0.01 to 0.1 mmol/g. When the polymer compound also has hydroxyl groups, the amount of the hydroxy groups is preferably in the range of 0.2 to 4.0 mmol/g, more preferably in the range of 0.3 to 3.0 mmol/g.

The amount of hydroxyl groups can be determined by a general titration method. For example, a reagent such as solution of pyridine in acetic anhydride or the like is added to the polymer compound and then heated, followed by adding water to hydrolyze the polymer compound. Then, the sample is separated with a centrifuge into the particles and a supernatant. The supernatant is titrated with an ethanolic solution of potassium hydroxide or the like with an indicator such as phenolphthalein, thereby determining the amount of hydroxyl groups.

The amount of carboxyl groups can also be determined by a general titration method. For example, the polymer compound is dispersed in N,N'-dimethylformamide and titrated with an ethanolic solution of potassium hydroxide or the like with an indicator such as phenolphthalein, thereby determining the amount of carboxyl groups.

When the carboxyl group has formed a salt structure (—COO—$Y^+$ wherein $Y^+$ represents an alkali metal ion or an alkaline earth metal ion, or an organic cation such as ammonium) described later, the amount of the carboxyl group can be determined by converting the salt with an acid such as hydrochloric acid into the corresponding carboxylic acid and then titrating the resulting acid as described above.

That is, the amount of carboxyl groups refers to the amount of carboxyl groups which when some carboxyl groups form salt structures, include those carboxyl groups contributing to formation of the salt structures.

The polymer compound may be one copolymerized further with crosslinking monomers (crosslinking agent) as necessary. Preferable examples of the crosslinking agent include divinyl benzene, ethylene glycoldi(meth)acrylate, diethylene glycol di(meth)acrylate, glycidyl(meth)acrylate and 2-([1'-methylpropylideneamino]carboxyamino)ethyl(meth)methacrylate. A crosslinked structure may be formed during polymerization, or polymer particles may be formed by polymerization and then crosslinked.

The amount of the crosslinking agent in the monomer mixture is preferably in the range of 0.05 to 20 parts by weight, more preferably in the range of 0.5 to 10 parts by weight, based on 100 parts by weight of the total of the (meth)acrylate monomer and/or styrene monomer.

A non-crosslinked resin may be contained in the polymer compound. The non-crosslinked resin is not particularly limited insofar as it is a polymer that may fix the particles on a fixing medium such as paper or film by means of external energy such as heat, UV-rays or electron beams, solvent vapor, sublimation of a solvent from the polymer, or the like.

Specific examples include homopolymers or copolymers of styrenes such as styrene and chlorostyrene, monoolefins such as ethylene, propylene, butylene, and isoprene, vinyl esters such as vinyl acetate, vinyl propionate, vinyl benzoate, and vinyl acetate, α-methylene aliphatic monocarboxylate esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate, vinyl ethers such as vinyl methyl ether, vinyl ethyl ether, and vinyl butyl ether, and vinyl ketones such as vinyl methyl ketone, vinyl hexyl ketone, and vinyl isopropenyl ketone.

When the polymer compound contains a non-crosslinked polymer, the molecular weight (number-average molecular weight) of the non-crosslinked polymer is preferably in the range of 5,000 to 1,000,000, more preferably in the range of 10,000 to 500,000.

The number-average molecular weight is determined by dissolving the polymer compound in THF, separating its soluble component, and measuring it by gel permeation chromatography (GPC).

-Magnetic Material-

The magnetic material used in the exemplary embodiment of the invention is preferably magnetite, ferrite or the like expressed by formula $MO.CFe_2O_3$ or $M.Fe_2O_4$ which is magnetic, may be preferably used. Yttrium-iron-garnet (YIG) is also preferably used. In the formula above, M represents a divalent or a monovalent metal ion (for example, Mn, Fe, Ni, Co, Cu, Mg, Zn, Cd or Li) and M may be a metal or a combination of metals. Examples of the magnetic material include iron oxides such as magnetite, γ-iron oxide, Mn—Zn ferrite, Ni—Zn ferrite, Mn—Mg ferrite, Li ferrite and Cu—Zn ferrite. Among these, magnetite that is inexpensive is preferably used.

Other metal oxides that can be used include nonmagnetic metal oxides such as those using one or more metals selected from Mg, Al, Si, Ca, Sc, Ti, V, Cr, Mn, Fe, Co, Ni, Cu, Zn, Sr, Y, Zr, Nb, Mo, Cd, Sn, Ba, Pb, etc., or the aforementioned magnetic metal oxides. For example, $Al_2O_3$, $SiO_2$, CaO, $TiO_2$, $V_2O_5$, $CrO_2$, $MnO_2$, $Fe_2O_3$, CoO, NiO, CuO, ZnO, SrO, $Y_2O_3$, $ZrO_2$, etc. may be used as a nonmagnetic metal oxide.

Among the magnetic powders illustrated above, magnetite, nickel, yttrium-iron-garnet (YIG), iron powder, γ-iron oxide, Ni—Zn ferrite, Mg—Mn ferrite, Cu—Zn ferrite, and Li—Zn ferrite are particularly preferably used.

The yttrium-iron-garnet (YIG) described above is described.

The magnetization of YIG particles in a 500 Oe magnetic field is preferably 10 emu/g or about 10 emu/g or more, more preferably 15 emu/g or about 15 emu/g or more, even more preferably 20 emu/g or about 20 emu/g or more.

The device used to measure the magnetic properties is a vibration sample type magnetism-measuring device (trade name: VSMP 10-15) manufactured by Toei Industry Co., Ltd. A sample to be measured is filled into a cell having an inside diameter of 7 mm and a height of 5 mm, and then the cell is set into the device. In the measurement, a magnetic field is applied to the sample, and sweeping up to a maximum value of 500 Oe (oersteds) is performed. Next, the applied magnetic field is decreased to prepare a hysteresis curve. From this hysteresis curve, the magnetization at 500 Oe (oersteds) is determined.

In the invention, the surfaces of YIG particles may be hydrophobicized. The method of the hydrophobicizing treatment is not particularly restricted and may be achieved for example by covering the surfaces of the magnetic powders (YIG particles) with a hydrophobicizing agent such as various types of coupling agents, silicone oils, and resins. In particular, it is preferable to treat the YIG particles by covering their surfaces with a coupling agent.

Because the surfaces of the YIG particles are basically hydrophilic, the hydrophobicizing treatment can enhance the compatibility of the polymer compound with hydrophobic monomers.

The content of YIG particles in the hydrophobic particles in the exemplary embodiment of the invention is preferably 13% by weight or about 13% by weight or less, more preferably 10% by weight or about 10% by weight or less, even more preferably 8% by weight or about 8% by weight or less. At the same time, the content of the YIG particles in the hydrophobic particles is preferably 1.4% by weight or about 1.4% by weight or more, more preferably 2% by weight or about 2% by weight or more, even more preferably 3% by weight or about 3% by weight or more.

Now, the method for producing YIG particles will be described. The method for producing YIG particles includes a method for producing the particles by a bottom-up means such as co-precipitation or a method for producing the particles by a top-down means such as milling.

However, when the YIG articles are produced, the following methods for example are preferably used to meet the X-ray diffraction characteristics described above.

1) A method wherein regardless of the bottom-up or top-down means, annealing treatment is carried out as posttreatment for the purpose of promoting crystallization and of preventing YIG particles from becoming amorphous particles causing a reduction in magnetization. The treatment temperature in this annealing treatment is preferably for example 700 to 1500° C., more preferably 800 to 1200° C.

2) A method wherein in the case of the top-down means, a wet process is carried out for the purpose of reducing the physical burden on raw material YIG particles and of preventing YIG particles from becoming amorphous particles. The liquid used in this wet process includes water, an alcohol (for example, isopropanol alcohol, ethanol or the like), acetone, hexane. The amount of this liquid used is 1 g or more every 2 g of the particles.

The co-precipitation method represented by the bottom-up means is a method of using a co-precipitation phenomenon, wherein a substance that does not precipitate by itself is precipitated by allowing it to be coexistent with another substance with which the substance is precipitated. Specifically, a mixed solution of an aqueous solution of yttrium metal salt and an aqueous solution of trivalent iron salt is mixed with an alkali aqueous solution, thereby generating co-precipitates.

Preferable examples of the alkali aqueous solution include an aqueous solution of NaOH. Examples of the alkali aqueous solution include aqueous solutions of $NH_4OH$, $(NH_4)_2CO_3$, $Na_2CO_3$, $NaHCO_3$. The alkali concentration of the alkali aqueous solution may be established in consideration of pH in the co-precipitation reaction.

The yttrium metal salt includes, for example, halides (chloride ($YCl_3$) and bromide ($YBr_3$)), nitrate ($Y(NO_3)_2$), and salt.

The trivalent iron salt includes, for example, halides (chloride ($FeCl_3$), bromide ($FeBr_3$) etc.), sulfate ($Fe_2(SO_3)_3$), and nitrate ($Fe(NO_3)_3$).

When an aqueous solution of the yttrium metal salt and an aqueous solution of the trivalent iron salt are dropped into the alkali aqueous solution, during which the co-precipitation reaction proceeds to form co-precipitates as YIG particles, it is preferable that the rate of dropping the two aqueous solutions of the metal salts to the alkali aqueous solution is preferably 10 to 100 ml/min., more preferably 20 to 60 ml/min., in the co-precipitation reaction, in order that the average primary particle size of the resulting YIG particles is 1 to 500 nm.

The stirring time, during and after dropping is preferably 10 to 60 minutes, more preferably 30 to 60 minutes.

The final pH value of the aqueous reaction liquid in the co-precipitation reaction is preferably 12 or more, more preferably 12.5 to 13.8, even more preferably 13 to 13.5.

The co-precipitates when evaporated to dryness are heated preferably at 50 to 200° C., more preferably 100 to 200° C.

Milling represented by the top-down means is carried out by using any of various grinding mills. The milling method used includes, for example, milling methods with a jet mill, a vibrating mill, a ball mill, a planetary mill, a beads mill, and a disk mill. Among these methods, a beads mill method, particularly a wet beads mill method, which exerts fewer burdens on YIG particles, is preferable.

The YIG particles used as a raw material to be milled may be YIG particles obtained by the co-precipitation method described above, or may be commercially available YIG particles. Examples of such commercially available YIG particles include Yttrium Iron Oxide, nanopowder (manufactured by Aldrich) and yttrium-iron-garnet $Y_3Fe_5O_{12}$ (manufactured by Japan Pure Chemical Co., Ltd.).

The average primary particle size of the magnetic material used in the exemplary embodiment of the invention is preferably in the range of 0.02 to 2.0 μm.

The content of the magnetic material in the hydrophobic particles in the exemplary embodiment of the invention is 2.5 to 50% by weight, more preferably in the range of 3.0 to 40% by weight, even more preferably in the range of 4.0 to 30% by weight.

(Rust-Preventing Treatment of the Magnetic Material)

From the viewpoint of preventing the magnetic material in the hydrophobic particles from rusting, the magnetic material may be subjected to rust-preventing treatment. The rust-preventing treatment refers to a treatment capable of preventing oxidation of the magnetic material.

Specific examples of the rust-preventing treatment include, for example, coupling treatment, treatment with an oxide film, treatment with a resin film, and treatment with a metal film.

Hereinafter, each of the treatments will be described.

The coupling treatment is carried out by dispersing the magnetic material in a silane coupling agent dissolved in a solvent, then evaporating the solvent, and heat-treating the residues, thereby achieving rust preventing treatment.

The silane coupling agent includes, for example, a silane coupling agent, a titanium coupling agent. A silane coupling agent is more preferably used, and a silane compound having a structure represented by formula (1) below is particularly preferable.

$$R_mSiY_n \quad (1)$$

wherein R represents an alkoxy group, m is an integer of 1 to 3, Y represents a hydrocarbon group such as an alkyl group, a vinyl group, a glycidoxy group, or a methacryl group, and n is an integer of 1 to 3.

Specific examples of the silane coupling agent include, for example, vinyltrimethoxysilane, vinyltriethoxysilane, γ-methacryloxypropyltrimethoxysilane, vinyltriacetoxysilane, methyltrimethoxysilane, methyltriethoxysilane, isobutytrimethoxysilane, dimethyldimethoxysilane, dimethyldiethoxysilane, trimethylmethoxysilane, hydroxypropyltrimethoxysilane, phenyltrimethoxysilane, phenethyltrimethoxysilane, n-hexadecyltrimethoxysilane, and n-octadecyltrimethoxysilane.

The treatment with an oxide film is carried out by selectively oxidizing the surface of the magnetic material only to cover the surfaces of the particles with an oxide film, thereby achieving rust preventing treatment.

The treatment with a resin film is carried out by dispersing the magnetic material in a resin dissolved in a solvent, then evaporating the solvent, and heat-treating the residues, thereby achieving rust preventing treatment.

The treatment with a metal film is carried out by vapor-depositing a hardly oxidized metal such as gold or platinum onto the surfaces of the particles by sputtering or the like to form a metal film, thereby achieving rust preventing treatment.

-Colorant-

For the purpose of coloring the polymer compound, the hydrophobic particles in the exemplary embodiment of the invention may further contain colorants such as a pigment, carbon black and a dye. In this case, the additives described above may be added to a mixture of monomers etc. having the magnetic material dispersed therein or may be previously mixed with the magnetic material, the monomers etc., and the dispersion treatment of the magnetic material and the dispersion treatment of the additives may be carried out simultaneously in the method for producing the hydrophobic particles.

The inorganic pigment includes, for example, an inorganic pigment such as colcothar, ultramarine blue, titanium oxide and chrome oxide; an azo pigment such as Fast Yellow, Disazo Yellow, pyrazolone red, chelate red, Brilliant Carmine, Para Brown and Nitroso Green; a phthalocyanine pigment such as copper phthalocyanine, nonmetal phthalocyanine and phthalocyanine green; a condensation polycyclic pigment such as flavanthrone yellow, dibromoanthrone orange, perylene red, Quinacridone Red and Dioxazine Violet.

In the hydrophobic particles in the exemplary embodiment of the invention, coloring pigments such as magenta, yellow, cyan, red and green are preferably used.

Specific examples include pigments such as chrome yellow, hansa yellow, benzidine yellow, threne yellow, quinoline yellow, Permanent Yellow FGL, Permanent Orange GTR, pyrazolone orange, vulkan orange, watchung red, Permanent Red, Dupont oil red, lithol red, rhodamine B lake, lake red C, rose bengal, aniline blue, ultramarine blue, calco oil blue, methylene blue chloride, phthalocyanine blue, PV fast blue, phthalocyanine green, malaehite green oxalate, chrome green, viridian, emerald green, Heliogen Green, Pigment Green B, Malachite Green Lake, Fanal Green, Fanal Yellow Green, C.I. Pigment Yellow 1, 2, 3, 12, 13, 14, 16, 17, 73, 74, 75, 83, 93, 95, 97, 98, 114, 120, 128, 129, 151, 154, 175, 180, 181, 194, C.I. Pigment Red 5, 7, 9, 11, 12, 48, 48:1, 57, 57:1, 81, 97, 112, 122, 123, 146, 149, 168, 177, 180, 184, 192, 202, 209, 213, 215, 216, 217, 220, 223, 224, 226, 227, 228, 238, 240, 254, 255, 264, 270, 272, C.I. Pigment Green 7, 36, 8, C.I. Pigment Blue 15, 15:1, 15:2, 15:3, 15:4, 15:6, 16, etc., and these colorants may be used alone or in combination of two or more thereof.

Among these pigments, C.I. Pigment Yellow 17, 74, 180, C.I. Pigment Red 57:1, 122, C.I. Pigment Green 7, 36, 8, C.I. Pigment Blue 15:1, 15:2, 15:3, and 15:4 are preferable pigments from the viewpoint that even when the hydrophobic particles are swollen due to absorbing water, the pigment is hardly eluted from the particles and thus hardly reduces its concentration.

The content of the colorant in the hydrophobic particles in the exemplary embodiment of the invention is preferably 1 to 30 parts by weight based on 100 parts by weight of the polymer compound, and it is also effective to use a surface-treated colorant and a pigment dispersant if necessary. By selecting the type of the colorant, a yellow toner, a magenta toner, a red toner, a green toner etc. are obtained.

-Other Components-

Depending on the intended object, the hydrophobic particles in the exemplary embodiment of the invention may contain components such as a releasing agent, inorganic particles, a lubricant and an abrasive. The releasing agent used herein includes, for example, low-molecular weight polyolefins such as polyethylene, polypropylene, and polybutene; silicones having a softening point under heat; fatty acid amides such as oleic acid amide, erucic acid amide, ricinolic acid amide, and stearic acid amide; long-chain fatty alcohols such as lauryl alcohol, stearyl alcohol, and behenyl alcohol; vegetable waxes such as carnauba wax, rice wax, candelilla wax, Japan wax, and jojoba oil; animal waxes such as beeswax; mineral or petroleum waxes such as montan wax, ozokerite, ceresin, paraffin wax, microcrystalline wax, and Fischer Tropsch wax; and modifications thereof.

-Method for Producing Hydrophobic Particles- For obtaining hydrophobic particles, known methods are used; for example, suspension polymerization, emulsion polymerization, dispersion polymerization, seed polymerization, and kneading/milling are preferably used. Suspension polymerization may be carried out by using an emulsion method known as a membrane emulsification technique.

Specifically, when the hydrophobic particles are prepared by suspension polymerization for example, a mixture containing monomers constituting the polymer compound, a magnetic material, a colorant, a crosslinking agent, a polymerization initiator is first prepared.

As the crosslinking agents to be used, known crosslinking agents may be selected and used. Preferable examples thereof include divinyl benzene, ethylene glycol di(meth)acrylate, diethylene glycol di(meth)acrylate, methylene bis(meth) acrylamide, glycidyl(meth)acrylate and 2-([1'-methylpropylideneamino]carboxyamino)ethyl methacrylate. Among these, divinyl benzene, ethylene glycol di(meth)acrylate and diethylene glycol di(meth)acrylate are desirable, and divinyl benzene is particularly preferable. As the polymerization initiator, an azo polymerization initiator, peroxide initiator etc. are preferable, and an oil-soluble initiator is particularly preferable.

In the method of preparing a mixture containing the monomers and the like, for example, the monomers, a polymerization initiator and other necessary components are first mixed to prepare a mixture of the monomers and the like. A mixing method is not particularly restricted.

Then, the magnetic material is dispersed therein. The magnetic material is dispersed in the mixture solution by a known method. That is, a dispersing apparatus such as a ball mill, a sand mill, an attritor or a roll mill may be used. When a monomer component is separately polymerized in advance and the magnetic material is dispersed in the resultant polymer, a kneader such as a roll mill, a kneader, a Banbury mixer or an extruder may be used.

The method for producing the mixture is not limited to the method described above. For example, a mixture in which the magnetic material was mixed may be used to mix the magnetic material in preparation of the mixture described above, or the monomers, magnetic material etc. may be mixed at once to give the mixture.

Then, the mixture containing the monomers etc. is suspended in an aqueous medium. Suspension is carried out for example in the following manner.

That is, the above mixture is introduced into and suspended in an aqueous medium containing a dispersion stabilizer and a salt such as an inorganic salt dissolved therein. As a suspension method, a known suspension method may be used. For example, mechanical suspension methods such as a method wherein a special stirring blade such as in a mixer is rotated at a high speed to suspend the monomers or the like in the aqueous medium, a method wherein suspension is carried out by a shearing force applied by a rotor-stator known as a homogenizer, or a method of ultrasonic wave suspension may be used.

Then, particles containing the suspended monomers, the magnetic material, and the like are suspension-polymerized to yield hydrophobic particles. This polymerization reaction may be carried out not only under atmospheric pressure but also under a pressurized condition. The other reaction conditions may be applied as required and are not particularly restricted.

From the viewpoint of obtaining polymer particles with a yield of 80% or more, the reaction is preferably carried out under conditions where the suspension containing the suspension particles dispersed therein is stirred for example at a reaction temperature of about 40° C. to 100° C. for 1 to 24 hours under atmospheric pressure.

The density of the hydrophobic particles in the particle dispersion liquid in the exemplary embodiment of the invention is preferably in the range of 0.5 to 40% by weight, more preferably 1 to 20% by weight.

Acetylene Glycol Surfactant

The particle dispersion liquid in the exemplary embodiment of the invention contains an acetylene glycol surfactant. Specific examples of the acetylene glycol surfactant include polyoxyethylene acetylene glycol ether (including commercial products such as SURFYNOL 465 manufactured by Nissin Chemical Industry Co., Ltd. and DYNOL 604 manufactured by Nissin Chemical Industry Co., Ltd.).

When the acetylene glycol surfactant is adsorbed onto the acrylic resin-containing hydrophobic particles, the particles are swollen due to incorporating water, as described above.

The content of the acetylene glycol surfactant in the particle dispersion liquid in the exemplary embodiment of the invention is preferably 0.1 or about 0.1 to 5 or about 5% by weight, more preferably 0.2 or about 0.2 to 4 or about 4% by weight, even more preferably 0.5 or about 0.5 to 2 or about 2% by weight.

When the content of the surfactant is 0.1% by weight or more, the particles are efficiently swollen, while when the content of the surfactant is 5% by weight or less, the surfactant remaining as a residue in the particle dispersion liquid can be effectively reduced.

In addition to the acetylene glycol surfactant, other surfactants may be simultaneously used. As other surfactants, any known surfactants such as an anionic surfactant, a nonionic surfactant, a cationic surfactant and an amphoteric surfactant may be used.

The anionic surfactant may be for example an alkylbenzene sulfonate, an alkylphenylsulfonate, an alkylnaphthalenesulfonate, a higher aliphatic acid salt, a sulfuric acid ester salt of a higher aliphatic acid ester, a sulfonic acid salt of a higher aliphatic acid ester, a sulfuric acid ester salt of higher alcohol ether, a sulfonic acid salt of higher alcohol ether, a salt of a higher alkyl sulfosuccinate, a salt of a higher alkyl phosphoric acid ester, or a salt of a phosphoric acid ester of a higher alcohol ethylene oxide adduct.

Examples of the nonionic surfactant include a polypropyleneglycol ethyleneoxide adduct, a polyoxyethylene alkylphenyl ether (polyoxyethylene nonylphenyl ether, polyoxyethylene octylphenyl ether, polyoxyethylene dodecylphenyl ether or the like), a polyoxyethylene alkyl ether (polyoxyethylene oleyl ether, polyoxyethylene cetyl ether, polyoxyethylene lauryl ether or the like), polyoxyethylene aliphatic acid ester, polyoxyethylene sorbitan aliphatic acid ester, and aliphatic acid alkylolamide.

Examples of the cationic surfactant include a salt of a tetraalkylammonium, a salt of an alkylamine, a salt of benzarconium, a salt of an alkylpyridinium, and a salt of imidazolium.

The amphoteric surfactant includes, for example, alkyldimethylamine oxide, alkylcarboxy betaine.

Other surfactants include not only the surfactants described above but also silicone-based surfactants such as polysiloxaneoxyethylene adduct and the like, fluorine-based surfactants such as perfluoroalkylcarboxylate salt, perfluoroalkylsulfonate salt, oxyethylene perfluoroalkyl ether and the like, and biosurfactants such as spicryspalic acid, rhamnolipid, lysolecithin.

-Water (Aqueous Medium)-

The particle dispersion liquid in the exemplary embodiment of the invention contains an aqueous medium containing at least water. The water includes purified water such as distilled water, deionized water or ultrapure water. The aqueous medium may contain a dispersant intended to maintain the dispersibility etc. of the hydrophobic particles, a water-soluble organic solvent intended to regulate evaporability and interfacial property, and other additives.

-Dispersant-

As a dispersant, a polymer having a hydrophilic structural moiety and a hydrophobic structural moiety can be effectively used. Specific examples include a styrene-styrene sulfonic acid copolymer, styrene-maleic acid copolymer, styrene-methacrylic acid copolymer, styrene-acrylic acid copolymer, vinylnaphthalene-maleic acid copolymer, vinylnaphthalene-methacrylic acid copolymer, vinylnaphthalene-acrylic acid copolymer, alkyl acrylate-acrylic acid copolymer, alkyl methacrylate-methacrylic acid copolymer, styrene-alkyl methacrylate-methacrylic acid copolymer, styrene-alkyl acrylate-acrylic acid copolymer, styrene-phenyl methacrylate-methacrylic acid copolymer, and styrene-cyclohexyl methacrylate-methacrylic acid copolymer These copolymers have a structure of a random, block or graft copolymer.

To improve dispersibility and water solubility, these polymers may have been copolymerized with a monomer having a polyoxyethylene group or a hydroxyl group or a monomer having a cationic functional group. The polymer having a hydroxyl group as an acidic group may have a salt structure with a basic compound.

-Water-Soluble Organic Solvent-

The water-soluble organic solvent refers to an organic solvent which when added to water, is not separated into 2 phases, and specific examples include monohydric or polyhydric alcohols, nitrogen-containing solvents, sulfir-containing solvents, and derivatives thereof.

Specific examples of the polyhydric alcohols include ethylene glycol, diethylene glycol, propylene glycol, butylene glycol, triethylene glycol, 1,5-pentane diol, 1,2,6-hexane triol and glycerin.

Specific examples of the polyhydric alcohol derivative include ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, and ethylene oxide adducts of diglycerin.

Specific examples of the monohydric alcohols include ethanol, isopropyl alcohol, butyl alcohol, and benzyl alcohol.

Specific examples of the nitrogen-containing solvent include pyrrolidone, N-methyl-2-pyrrolidone, cyclohexyl pyrrolidone, and triethanol amine.

Specific examples of the sulfur-containing solvent include thiodiethanol, thiodiglycerol, sulfolane, and dimethyl sulfoxide.

In addition, it is also possible to use propylene carbonate and ethylene carbonate as a water-soluble organic solvent.

When the water-soluble organic solvent is added, the content thereof is preferably 30% by weight or less, more preferably 10% by weight or less, based on the total mass of the dispersion medium.

-Other Additives-

Alkali metal compounds such as potassium hydroxide, sodium hydroxide and lithium hydroxide; nitrogen-containing compounds such as ammonium hydroxide, triethanolamine, diethanolamine, ethanolamine, and 2-amino-2-methyl-1-propanol; alkaline earth metal compounds such as calcium hydroxide; acids such as sulfuric acid, hydrochloric acid, and nitric acid; and salts between a strong acid and a weak alkali, such as ammonium sulfate, may be added to the aqueous medium, for the purpose of regulating electric conductivity, ink pH etc.

If necessary, other additives such as benzoic acid, dichlorophene, hexachlorophene and sorbic acid may be added for purposes such as mildew proofing, asepticus, corrosion resistance, etc. In addition, an antioxidant, a viscosity regulator, an electroconductive material, an UV absorber, a chelating agent, etc. may also be added.

(Method for Producing the Particle Dispersion Liquid)

Production of the particle dispersion liquid in the exemplary embodiment of the invention is carried out by the following procedure, but the invention is not limited thereto.

First, a dispersion medium containing a main solvent water, an acetylene glycol-based surfactant, and if necessary the additives described above is prepared with a magnetic stirrer or the like, and the acrylic resin-containing hydrophobic particles described above are dispersed therein.

For dispersion, a known method is applied. That is, a dispersing apparatus such as a ball mill, a sand mill, an atrighter or a roll mill is used. The dispersion method includes a method of dispersion by rotating, at high speed, a special stirring blade such as in a mixer, a method of dispersion with shearing force with a rotor-stator known as a homogenizer, and a method of dispersion by ultrasonic wave.

It is confirmed by observation under a microscope or the like that the hydrophobic particles are dispersed alone. Thereafter, additives such as a preservative are added and confirmed to be completely dissolved, and the resulting dispersion liquid is filtered through a meth having 100 μm pores to remove foreign particles and coarse particles, thereby yielding an image forming recording liquid.

(Characteristics of the Particle Dispersion Liquid)-

-Ratio of Particle Size in Swollen State to Particle Size in Dried State-

In the particle dispersion liquid in the exemplary embodiment of the invention, the particle size, in a state of being swollen due to absorbing water until saturation, of the hydrophobic particles to which the acetylene glycol surfactant was adsorbed is 1.1 or about 1.1 to 2 or about 2 times as large as the particle size thereof in a dried state, as described above. When this ratio is less than 1.1, the particles are not in a sufficiently swollen state, thus making fixation with low energy difficult. When the ratio is more than 2, the particles cannot sufficiently attain strength and may thus be finely divided in the solution.

The ratio is preferably 1.1 to 1.8, more preferably 1.1 to 1.5.

-Surface Tension of the Particle Dispersion Liquid-

The surface tension of the particle dispersion liquid when used particularly as a developer for forming an image by liquid magnetography is preferably 15 to 42 mN/m, more preferably 18 to 41 mN/m, even more preferably 19 to 39 mN/nm.

-Viscosity of the Particle Dispersion Liquid-

The viscosity of the particle dispersion liquid when used particularly as a developer for forming an image by liquid magnetography is preferably 0.9 to 10.0 mPa·s, more preferably 0.9 to 5 mPa·s, even more preferably 0.9 to 4 mPa·s.

<Particles>

As described above, the particles in the exemplary embodiment of the invention contain at least (meth)acrylic resin and an acetylene glycol surfactant, as well as a colorant such as a pigment or the like and a magnetic material. The particle size of the particles in a state of being swollen due to absorbing water until saturation is 1.1 or about 1.1 to 2 or about 2 times as large as the particle size thereof in a dried state.

A composition consisting of the (meth)acrylic resin, the acetylene glycol surfactant, the colorant and the magnetic material, which are contained in the particles in the exemplary embodiment of the invention, uses those illustrated in the description of the particle dispersion liquid in the exemplary embodiment of the invention.

The content of the acetylene glycol surfactant in the particles in the exemplary embodiment of the invention is preferably 0.01 to 20% by weight more preferably 0.1 to 10% by weight, even more preferably 0.5 to 10% by weight.

When the content of the surfactant is 0.01% by weight or more, the particles are efficiently swollen, while when the content is 20% or less, the surfactant remaining as a residue in the particle dispersion liquid can be effectively reduced.

(Method for Producing the Particles)

The particles in the exemplary embodiment of the invention are produced by drying the particle dispersion liquid in the exemplary embodiment of the invention to evaporate the water-containing aqueous medium. The method for producing the particle dispersion liquid is as described above.

Alternatively, the particles in the exemplary embodiment of the invention can also be obtained by the following method.

•Kneading Milling Method

When the hydrophobic particles are produced by kneading milling in the method for producing the hydrophobic particles as described above, an oily acetylene glycol surfactant is kneaded in the raw materials before milling, followed by milling, thereby yielding the particles in the exemplary embodiment of the invention.

(Characteristics of the Particles)

-Ratio of Particle Size in Swollen State to Particle Size in Dried State-

As described above, the particle size of the particles in the exemplary embodiment of the invention in a state of being swollen due to absorbing water until saturation is 1.1 or about 1.1 to 2 or about 2 times as large as the particle size thereof in a dried state. When this ratio is less than 1.1, the particles are not in a sufficiently swollen state, thus making fixation with low energy difficult. When the ratio is more than 2, the particles cannot sufficiently attain strength and may thus be finely divided in the liquid.

The ratio is preferably 1.1 to 1.8, more preferably 1.1 to 1.5.

<Process Cartridge, Image Forming Apparatus>

As described above, the particle dispersion liquid and the particles in the exemplary embodiment of the invention are used preferably as a developer for forming an image and used particularly preferably as a developer for forming an image by liquid magnetography.

Herein, an image-forming apparatus in a liquid magnetographic system will be described as the image-forming apparatus in the exemplary embodiment of the invention. Liquid magnetographic system is a method in which pattern-like magnetic latent images such as characters and images are formed and then the magnetic latent image is visualized by use of a liquid developer having a magnetic toner (the hydrophobic particles in the exemplary embodiment of the invention) dispersed in a liquid, thereby producing a hard copy.

Specifically, the image forming apparatus in the exemplary embodiment of the invention includes a magnetic latent image holding member (also referred to hereinafter as "image holding member"), a magnetic latent image forming unit that forms a magnetic latent image on the magnetic latent image holding member, a developer storing unit that stores the developer (the particle dispersion liquid), a developer feeding unit that feeds the developer to the magnetic latent image holding member on which the magnetic latent image was formed, to visualize the magnetic latent image as a toner image, a transfer unit that transfers the toner image onto a recording medium, and a demagnetizing unit that demagnetizes the magnetic latent image on the magnetic latent image holding member.

In the exemplary embodiment of the invention, the surface of the image holding member preferably has water repellency. As described above, the developer used in the exemplary embodiment of the invention uses a water-containing dispersion medium. Accordingly, the surface of the image holding member has water repellency so that even when the developer is contacted with the image holding member in the development step, the dispersion medium is hardly transferred onto the image holding member, and while the dispersion medium is not left on the image holding member, the toner image is transferred onto a recording medium. Accordingly, squeeze rollers for removing a residual solvent on the image holding member are unnecessary, and it is scarcely necessary to dry the recording medium onto which the toner image was transferred.

Because the developer has the constitution described above, the dispersion medium does not spread on the surface of the image holding member in the development step, and the magnetic toner (the hydrophobic particles in the exemplary embodiment of the invention), upon contacting with the image holding member, spreads on only the magnetic latent image region with magnetic force, thus making development less liable to image fogging.

FIG. 1 is a skeleton framework showing one example of the image forming apparatus in the exemplary embodiment of the invention. The image forming apparatus 100 is composed of a magnetic drum (magnetic latent image holding member) 10, a magnetic head (magnetic latent image forming unit) 12, a developing unit (a developer storing unit and a developer feeding unit) 14, an intermediate transfer body (transfer unit) 16, a cleaner 18, a demagnetizing unit 20, and a transfer fixing roller (transfer unit) 28. The magnetic drum 10 has a cylindrical shape and is provided on or over the periphery of the magnetic drum 10 with the magnetic head 12, the developing unit 14, the intermediate transfer body 16, the cleaner 18 and the demagnetizing unit 20 in this order.

Hereinafter, the working of the image forming apparatus 100 will be briefly described.

The magnetic head 12 is connected for example to an information device (not shown) and receives binary image data sent from the information device. The magnetic head 12 scans the side of the magnetic drum 10 and simultaneously emits a line of magnetic force, thereby forming magnetic latent images 22 on the magnetic drum 10. In FIG. 1, the magnetic latent images 22 are shown by shaded portions in the magnetic drum 10.

The developing unit 14 is composed of a developing roller (developer feeding unit) 14*a* and a developer storing container (developer storing unit) 14*b*. The developing roller 14*a* is arranged so as to be dipped partially in the liquid developer (developer) 24 stored in the developer storing container 14*b*.

The liquid developer 24 fed to the developing roller 14*a* rotating in the direction A is delivered, in a feed amount restricted by a regulating member described later, to the magnetic drum 10 and fed to the magnetic latent image 22 at the position where the developing roller 14*a* and the magnetic drum 10 come close to each other (or contacted with each other). The magnetic latent image 22 is thereby visualized as a toner image 26.

The developed toner image 26 is delivered with the magnetic drum 10 rotating in the direction B in FIG. 1 and transferred onto paper (recording medium) 30. In the exemplary embodiment of the invention, the toner image before transfer onto paper 30 is transferred once onto the intermediate transfer body 16 in order to improve the efficiency of transfer of the toner image (including the efficiency of release of the toner image from the magnetic drum 10) onto the recording medium and to attain transfer and fixation simultaneously on the recording medium. In the exemplary embodiment of the invention, the intermediate transfer body 16 is used, but the toner image may be transferred from the magnetic drum 10 directly onto paper 30 without using the intermediate transfer body 16.

Because the magnetic toner (the hydrophobic particles in the exemplary embodiment of the invention) hardly has electric charge, the transfer thereof onto the intermediate transfer body 16 is achieved preferably with shearing transfer (that is, non-electric-field transfer). Specifically, the magnetic drum 10 rotating in the direction of the arrow B, and the intermediate transfer body 16 rotating in the direction of the arrow C, are contacted with each other at a certain contact part (at a contact surface having contact width in the direction of movement), so that the toner image 26 is transferred onto the intermediate transfer body by higher adsorption force than the magnetic force of the magnetic drum 10 which is exerted on the toner image 26. At this time, there may be a circumferential velocity difference between the magnetic drum 10 and the intermediate transfer body 16.

Then, the toner image 26 delivered with the intermediate transfer body 16 in the direction of the arrow C is transferred onto, and simultaneously fixed on, paper 30 at the position of contact between the intermediate transfer body 16 and the transfer fixing roller 28. Specifically, the paper 30 is put between the transfer fixing roller 28 and the intermediate transfer body 16, and the toner image 26 on the intermediate transfer body 16 is attached firmly to the paper 30 and thereby transferred and simultaneously fixed thereon.

Fixation of the toner image may be achieved by pressurization, depending on the properties of the toner, or by pressurization and heating with a heating element arranged in the transfer fixing roller 28.

A residual toner on the magnetic drum 10 from which the toner image 26 was transferred onto the intermediate transfer body 16 is delivered to the position of contact with the cleaner 18 and recovered with the cleaner 18. After cleaning, the magnetic latent images 22 maintained on the magnetic drum 10 moves, by rotation, to the demagnetizing position.

The demagnetizing unit 20 erases the magnetic latent images 22 formed on the magnetic drum lO. By the cleaner 18 and the demagnetizing unit 20 the magnetic drum 10 is returned to the evenly magnetized state of the magnetic layer before image formation. By carrying out the above operation repeatedly, images sent successively from the information device are formed continuously in a short time. The magnetic head 12, the developing unit 14, the intermediate transfer body 16, the transfer fixing roller 28, the cleaner 18 and the demagnetizing unit 20 arranged in the image forming apparatus 100 operate together in synchronization with the rotation velocity of the magnetic drum 10.

Now, the constitutions of the image forming apparatus in the exemplary embodiment of the invention will be described in order (Magnetic Latent Image Holding Member)

The magnetic drum (magnetic latent image holding member) 10 is constituted such that for example, an undercoat layer such as Ni or Ni—P is formed to a thickness of about 1 to 30 μm on a drum made of a metal such as aluminum, a magnetic recording layer such as Co—Ni, Co—P, Co—Ni—P, Co—Zn—P or Co—Ni—Zn—P is formed to a thickness of about 0.1 to 10 μm on the undercoat layer, and a protective layer such as Ni or Ni—P is formed to a thickness of 0.1 to 5 μm on the magnetic recording layer When defects such as pinholes occur in a plated metal layer as the undercoat layer, defects are also generated in the magnetic recording layer, and thus metal plating is carried out preferably to form a dense and even plated layer. Besides metal plating, there are methods such as sputtering and vapor deposition. The undercoat layer and protective layer are preferably nonmagnetic. The surface of each layer is preferably kept accurate by polishing with a tape or the like in order to accurately maintain the gap between itself and the magnetic head 12 for forming magnetic latent images.

The thickness of the magnetic recording layer is set preferably in the range of 0.1 to 10 μm, and the magnetic characteristics of the magnetic recording layer are set preferably such that the coercitivity reaches about 16000 to 80000 A/m (200 to 1000 oersteds (Oe)) and the remanent flux density reaches 100 to 200 mT (1000 to 2000 gausses (G)).

In the case of in a horizontal magnetic recording system, the magnetic drum 10 is constituted as described above. In the case of a vertical magnetic recording system, the magnetic drum may be constituted by arranging a recording layer such as Co—Ni—P on a nonmagnetic layer or by arranging a soft magnetic layer of high magnetic permeability under the recording layer. However, the invention is not limited to either magnetic recording system. The magnetic latent image holding member may be formed in a belt shape without limitation to the drum-shaped body in the exemplary embodiment of the invention.

In the exemplary embodiment of the invention, the magnetic drum 10 having water repellency is preferably used. Water repellency refers to a property of repelling water, and specifically the contact angle of the magnetic drum to purified water is 70° or more.

In the exemplary embodiment of the invention, the contact angle of the magnetic drum 10 to purified water is preferably 70° or more, more preferably 100° or more. When the contact angle is less than 70°, there are cases where if development is conducted with a liquid developer using an aqueous medium described later, a liquid remains on the magnetic drum after development, or image fogging is generated.

The contact angle of the surface of the magnetic drum 10 is measured by dropping 3.1 μl of purified water onto the surface of the magnetic drum, under the conditions of 25° C. and 50% RH, and 15 seconds later, measuring the contact angle of the water to the surface of the magnetic drum with a CA-X contact angle meter (manufactured by Kyowa Interface Science Co., Ltd.). This measurement is carried out at 4 points in ends and central regions in the circumferential direction, and their average is expressed as the contact angle.

In order that the surface of the magnetic drum 10 is made a surface having the preferable contact angle described above, the magnetic drum constituted above is subjected preferably to surface coating.

The surface coating includes fluorine-moistening plating, coating with fluorine atoms or silicon atoms. Fluorine moistening plating is functional plating wherein a fluorine resin (polytetrafluoride ethylene (PTFE)) is co-precipitated and combined with electroless nickel, thereby forming a film containing PTFE particles precipitated therein and having both characteristics of electroless nickel and PTFE resin.

A coating of a polymer containing fluorine atoms or silicon atoms may be formed for example by applying a polymer having a fluorine-containing cyclic structure, a fluoroolefin/vinyl ether copolymer or a photopolymerizable fluorine resin composition onto the surface of the protective layer or by sputtering a fluorine atom-containing polymer on the surface of the protective layer to cover the whole surface with the polymer.

Among them, fluorine-moistening plating is preferable from the viewpoint of durability and adhesion to a lower plated layer. The fluorine-moistening plating and fluorine resin coating may be carried out after the protective layer is formed, or a layer formed by fluorine-moistening plating or the like may be used directly as a protective layer.

The thickness of the surface layer formed by surface coating is preferably 0.1 to 5 μm, more preferably 0.3 to 3 μm.

(Magnetic Latent Image Forming Unit)

The magnetic latent image forming unit consists basically of a magnetic head 12 and its driving circuit. As the magnetic head 12, there are mainly a full-line magnetic head and a multi-channel magnetic head. In the case of the full-line magnetic head, scanning with the magnetic head 12 is not necessary, while in the case of the multi-channel magnetic head, scanning of the magnetic drum 10 with the magnetic head 12 is necessary. The scanning method includes serial scanning and helical scanning. In the helical scanning, the recording rate can be increased by specially changing the rate of revolutions of the magnetic drum 12, only in the step of forming latent images.

For coverage of the recording width, in the width direction, of A4 paper by the full-line magnetic head, a head of about 500 channels is necessary when the resolution is for example 600 dpi. When these channels are arranged to make the head full-line, recording at a very high speed is feasible without necessity for scanning with the head. To make the head full-line, superposition of head cores is necessary, and as the resolution increases, the track pitch decreases, and thus a coil that is as thin as possible (for example a planar sheet coil) is used as one inserted into the head core.

By passing an electric current through the coil of each channel in the magnetic head 12, leak magnetic flux is generated at the tops of magnetic poles, thereby magnetizing a magnetic recording medium to form a magnetic latent image thereon. The output power from the magnetic head 12 should be 2 or 3 times as high as the coersive force of the magnetic recording layer in the magnetic drum 10. The magnetic latent image formed herein does not disappear unless it is erased with the demagnetizing unit 20, and a function of copying on a large number of sheets is exhibited by repeatedly conducting the development, transfer, fixation and cleaning steps. The magnetic latent image is hardly influenced by humidity and is thus superior in environmental stability to that by the electrostatic system.

(Developer Storing Unit, Developer Feeding Unit)

Figure 2:
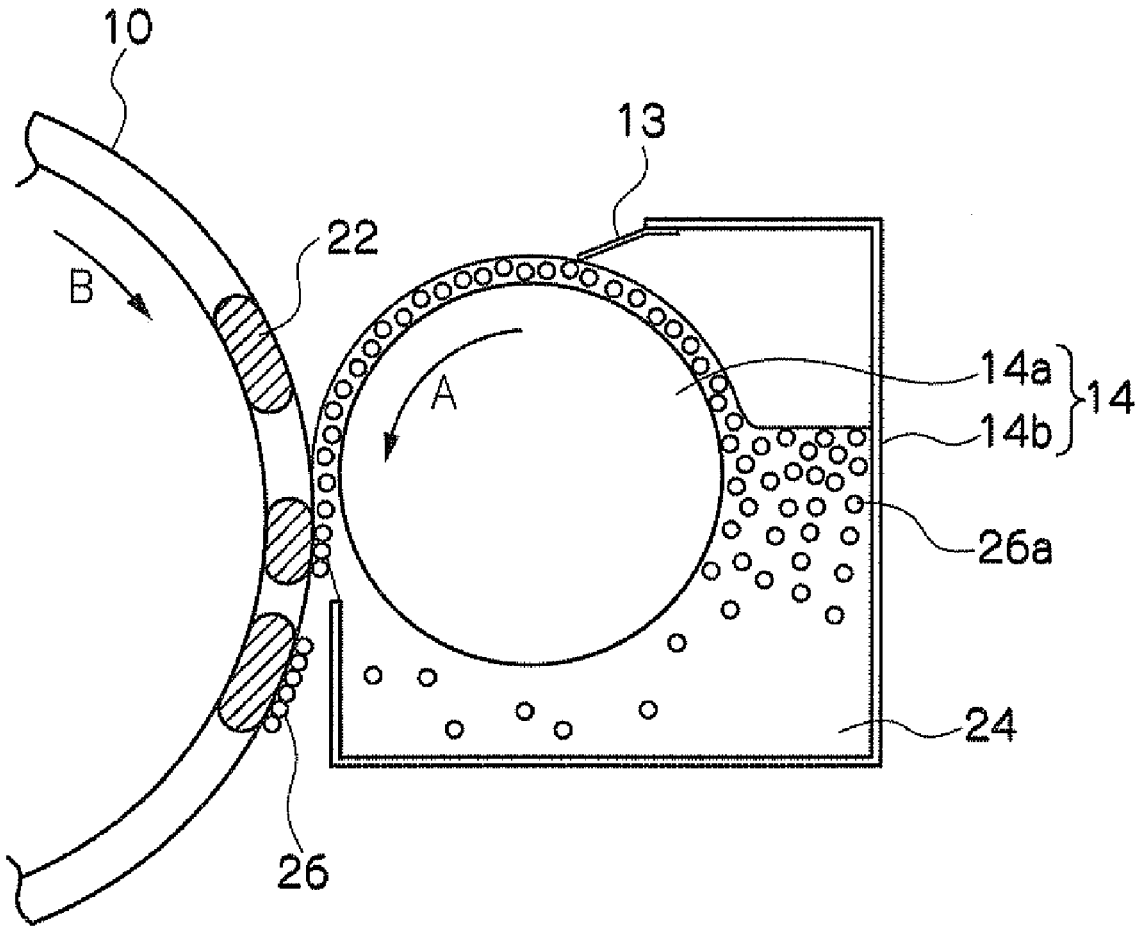
FIG. 2 is an enlarged schematic diagram of a developing region in one example of the image forming apparatus in the exemplary embodiment of the invention.

FIG. 2 is an enlarged schematic diagram of the developing region in FIG. 1.

The developing unit (developer feeding unit) 14 includes a developer storing container 14*b* and a developing roller 14*a* that feeds a liquid developer 24 stored in the developer storing container 14*b*, to a magnetic drum 10 in a toner feed region (also referred to hereinafter as "feed region"). As shown in FIG. 2, the developing roller 14*a* holds a layered liquid developer 24 on the circumference surface thereof and is disposed apart from the magnetic drum 10 (for example, the magnetic drum and the developing unit constitute a process cartridge). A regulating member 13 for keeping a predetermined thickness of the liquid developer 24 is arranged upstream of the feed region. The regulating member 13 is a plate-like member extending in the direction of the axis line across the full width of the developing roller 14*a*, and its one marginal part is arranged so as to be apart, by a predetermined distance corresponding to a desired thickness of the toner layer, from the circumferential surface of the developing roller 14*a*.

In the developing unit 14, the liquid developer 24 containing toner particles (hydrophobic particles) 26*a* and an aqueous medium (dispersion medium) is stored in the developer storing container 14*b*. The developing roller 14*a* is supplied with the liquid developer 24. If necessary, a stirring member may be arranged in the developer storing container 14*b* and used to stir the liquid developer at a predetermined revolution rate.

Although not shown in FIG. 2, a feeding roller in contact with, or close to, the developing roller 14*a* may be arranged to feed the liquid developer to the developing roller 14*a*.

The developing roller 14*a* is provided therein with the plural magnetic poles containing south and north magnetic poles, and these magnetic poles are fixed such that they are not rotated together with the developing roller 14*a*. One of these magnetic poles is arranged particularly between the regulating member 13 and the feed region. Accordingly, the liquid developer 24 containing the magnetic toner held with the developing roller 14*a* is held with the magnetic field lines (developing magnetic field) of these magnetic poles and delivered in the direction of the magnetic drum 10.

The developing roller 14*a* may not be a magnetic roller as long as the surface of the roller has force to deliver the liquid developer, and an Anilox roller or a sponge roller for example may be used.

As described above, the regulating member 13 is arranged between the position at which the developing roller 14*a* holds the liquid developer 24 from the developer storing container 14*b* and the position at which the developing roller 14*a* feeds it to the magnetic drum 10. The amount of the liquid developer 24 fed to the magnetic latent image 22 is determined by the gap formed by the regulating member 13 and the developing roller 14*a*. Its material is preferably rubber or phosphor bronze. The liquid developer 24 in a predetermined amount restricted with the regulating member 13 is delivered with the magnetic drum 10 and fed to the magnetic latent image 22. The magnetic latent image 22 is thereby visualized to form a toner image 26.

With respect to the development described above, the toner particles are magnetic toners, and thus development proceeds without applying a magnetic field to the developing roller 14*a*, but a magnetic field may be applied to the developing roller 14*a* to achieve more efficient development.

(Transfer Unit, Fixing Unit)

The toner image visualized with the developing unit 14 is transferred by the transfer unit onto paper 30. As described above, the exemplary embodiment of the invention uses a system in which the toner image is not transferred from the magnetic drum 10 directly onto paper, but is transferred once onto the intermediate transfer body 16 and then transferred and fixed on paper 30. First, transfer onto the intermediate transfer body 16 will be described.

The intermediate transfer body 16 is contacted with the magnetic drum 10 to transfer the toner image. Generally, the transfer system includes an electrostatic transfer system, a pressure transfer system, and an electrostatic pressure system using the two systems. As described above, the toner particles in the exemplary embodiment of the invention do not have charge and are thus not usable in the electrostatic system or in the electrostatic pressure system. The pressure transfer system is a system wherein the toner image is usually plastically deformed usually by the pressure between the magnetic drum 10 and the transfer medium and simultaneously adhered and transferred onto the surface of the transfer medium, and this system may be used in combination with shearing transfer.

In the exemplary embodiment of the invention, the toner image 26 on the magnetic drum 10 is transferred, with higher adsorption force than the magnetic force of the magnetic drum 10 exerted on the toner image 26, onto the intermediate transfer body, and thus the intermediate transfer body 16 is preferably endowed with adhesion to achieve adhesive transfer of the toner image thereon. Accordingly, a silicone rubber layer of low hardness is preferably formed on the surface of the intermediate transfer body 16.

Then, the toner image 26 transferred onto the intermediate transfer body 16 is transferred onto paper The intermediate transfer body 16 in FIG. 1 is provided at the side opposite to the magnetic drum 10, with a transfer fixing roller 28 such that the transfer fixing roller 28 forms a part of contact with the intermediate transfer body 16, and the paper 30 in accordance with the timing of the toner image 26 on the intermediate transfer body 16 is fed to the part of contact between the intermediate transfer body 16 and the transfer fixing roller 28. The transfer fixing roller 28 is composed of, for example, a stainless steel substrate, a silicone rubber layer, and a fluorine rubber layer, and the paper 30 passing through the contact part is pressed against the intermediate transfer body 16, thereby transferring the toner image on the intermediate transfer body 16 onto the paper 30.

In the exemplary embodiment of the invention, the toner image 26 is transferred from the intermediate transfer body 16 to the paper 30 and simultaneously the toner image 26 is fixed on the paper 30. Specifically, the intermediate transfer body 16, when formed in a roller shape as shown in FIG. 1, constitutes a roller pair with the transfer fixing roller 28, so that the intermediate transfer body 16 and the transfer fixing roller 28 are constituted in accordance with a fixing roller and a pressing roller respectively in a fixing apparatus, thereby exhibiting fixing performance. That is, when the paper 30 passes through the contact part, the toner image 26 is transferred and simultaneously pressed against the intermediate transfer body 16 by the transfer fixing roller 28, thereby softening the toner particles constituting the toner image 26 and penetrating the toner particles into fibers of the paper 30 to form a fixed image 29.

As described above, the transfer fixing roller 28 for example is provided with a heating element, and a toner image is heated with the heating element, whereby the toner image is melted to penetrate into fibers of the paper 30 and fixed to form a fixed image 29. In this state, even if the paper 30 is bent, or an adhesive tape is attached to it and then removed, the fixed image 29 is not removed.

In the exemplary embodiment of the invention, transfer onto, and fixation on, the paper 30 are simultaneously conducted, but the transfer step and the fixing step may be conducted separately such that after transfer, fixation may be conducted. In this case, the transfer roller for transferring the toner image from the magnetic drum 10 has a function equivalent to the function of the intermediate transfer body 16.

(Cleaner)

When the efficiency of transfer of the toner image from the magnetic drum 10 onto the intermediate transfer body 16 does not reach 100%, a part of the toner image 26 remains on the magnetic drum 10 after transfer. Cleaner 18 eliminates the residual toner, and is composed essentially of a cleaning blade made of rubber or the like and a container for storing residual magnetic toners.

When the transfer efficiency is nearly 100% and the residual toner is not problematic, cleaner 18 may not be arranged.

(Demagnetizing Unit)

When a new image is formed again, a previous magnetic latent image should be erased before a new magnetic latent image is formed with the magnetic head 12. For the demagnetizing unit 20, there are two systems, that is, a permanent-magnet system and an electromagnet system. In the permanent-magnet system, the magnetic drum 10 is magnetized in the circumferential direction and prevented from leaking magnetic flux partially and is inexpensive without necessity for energy such as electric power. However, when a magnetic latent image is not to be erased, the demagnetizing unit 20 should be transferred so as to be apart from the magnetic drum 10, thereby increasing the magnetic distance to weaken the erasing magnetic field. The electromagnet system, on the other hand, is composed of a yoke and a coil and requires passage of electric current, but when it is not necessary to erase a magnetic latent image, electric current is merely cut off to null the erasing magnetic field, thus making regulation feasible with ease.

In the exemplary embodiment of the invention, either the permanent-magnet system or the electromagnet system may be used.

EXAMPLES

Hereinafter, the present invention will be described in detail with reference to the Examples, but these examples are mere illustrative of the invention and not intended to limit the invention. In the Examples, "part" and "%" mean "part by weight" and "% by weight" respectively unless otherwise noted.

Example 1

Magnetic material-containing particles (referred to hereinafter as magnetic toner) and a particle dispersion liquid (hereinafter referred to as liquid developer) are prepared in the following manner.

(Preparation of Magnetic Material Particles)

As the magnetic material particles, 400 g of yttrium-iron-garnet $Y_3Fe_5O_{12}$ (average primary particle size 2.0 μm) manufactured by Japan Pure Chemical Co., Ltd. is dispersed in 400 g purified water and pulverized for 45 minutes with a beads mill (trade name: LMZ06, manufactured by Ashizawa Finetec Ltd.) with a beads diameter of 0.3 mm. The magnetic material particles removed from the beads mill are subjected to decantation and centrifugation, thereby removing fine and coarse powders, and then freeze-dried to give a dried product of magnetic material particles.

(Production of Magnetic Material-Containing Particles/Suspension Polymerization Method)

36 parts of n-butyl methacrylate (manufactured by Wako Pure Chemical Industries Ltd.), 38 parts of styrene monomer (manufactured by Wako Pure Chemical Industries Ltd.) and 11 parts of styrene-acrylic resin (trade name: ESLEC P-SE-0020, manufactured by Sekisui Chemical Co., Ltd.) are mixed with one another. 4.3 parts of the magnetic material particles obtained above and 10 parts of magenta pigment C.I. Pigment Red 185 (manufactured by Clariant (Japan) K. K.) are added to the mixture and dispersed for 24 hours with a ball mill. 5 parts of azobisisobutyronitrile (manufactured by Wako Pure Chemical Industries Ltd.) is added as a polymerization initiator to 90 parts of the mixture containing the magnetic material particles, thereby preparing a mixture containing the monomer, the magnetic material particles and the pigment.

30 parts of calcium carbonate (trade name: LUMINUS, manufactured by Maruo Calcium Co., Ltd.) and 3.5 parts of carboxy methyl cellulose (trade name: CELLOGEN, manufactured by Dai-ichi Kogyo Seiyaku Co., Ltd.) are added as dispersion stabilizers to an aqueous solution obtained by dissolving 28 parts of sodium chloride (manufactured by Wako Pure Chemical Industries Ltd.) in 160 parts of deionized water, and then the resulting mixture is dispersed for 24 hr by means of a ball mill to form a dispersion medium.

The above mixture is introduced into 200 parts of the dispersion medium, and the resultant product is emulsified at 8,000 rpm for 3 minutes by an emulsifying apparatus (trade name: HIGH-FLEX HOMOGENIZER, manufactured by SMT Co., Ltd.), thereby obtaining a suspension.

Separately, a separable flask provided with a stirrer, a thermometer, a cooling pipe and a nitrogen introducing pipe is charged with nitrogen through the nitrogen introducing pipe, thereby replacing the atmosphere in the flask by nitrogen. The above suspension is introduced into the flask and reacted at 65° C. for 3 hours, further heated to 70° C. for 10 hours, and cooled. The reaction liquid is an excellent dispersion and no aggregate is visually confirmed during the polymerization.

To the reaction liquid, an aqueous solution of 10% hydrochloric acid is added to decompose calcium carbonate, followed by subjecting the reaction liquid to solid-liquid separation by centrifugation. The obtained particles are washed 3 times with 1 L deionized water, followed by removing particles not containing the magnetic powder and particles containing too much magnetic powder under the processing speed of 4.4 l/min. with a magnet separator MSO (manufactured by Noritake Co., Limited). The obtained particles were vacuum-dried at 40° C., followed by cutting off coarse powder and fine powder, with air classifier (Elbow Jet) thereby giving magnetic material particle-containing particles (magnetic toner).

(Preparation of Particle Dispersion Liquid)

96 parts of deionized water is added to 5 parts of the magnetic toner obtained above and 1 part (1% by weight) of an acetylene glycol surfactant (trade name: Surfynol 465 manufactured by Nissin Chemical Industry Co., Ltd.; chemical structure: polyoxyethylene acetylene glycol ether), and then the mixture is dispersed under stirring for 3 hours with a ball mill to yield a particle dispersion liquid (liquid developer). (The content of the acetylene glycol surfactant in the particles in a dried state of the particle dispersion liquid from which deionized water was evaporated is 1% by weight)

(Ratio of Particle Size in Swollen State to Particle Size in Dried State)

By the method described above, the number-average primary particle size of the particles in a swollen state and the number-average primary particle size thereof in a dried state are measured to determine the ratio of the two. The calculation result is shown in Table 1.

(Evaluation)

-Evaluation of Dispersibility-

The dispersibility of the magnetic toner in the liquid developer is evaluated by the following method.

10 mL of the prepared liquid developer is sealed in a 16-mL screw cap test tube, then left for 1 day, set in a test tube shaker, stirred in a low-speed mode, then left, and from its state, the dispersibility is evaluated.

The evaluation criteria are as follows. The results are shown in Table 1.

Excellent: Particles disperse rapidly and the sedimentation speed is low. The shape of the particles is maintained when observed under an optical microscope.

Slightly bad: Stirring for 1 minute or more is required for dispersing the particles.

Particle breakage: Particles disperse rapidly, but when observed under an optical microscope, the shape of the particles is broken or is lacking.

-Evaluation of Fixation Temperature-

The image forming apparatus 100 constituted as shown in FIG. 1 is prepared wherein the developer used is the liquid developer described above.

In the magnetic drum 10, Ni—P is plated as an undercoat layer to a thickness of 15 μm on an aluminum drum, Co—Ni—P is plated as a magnetic recording layer to a thickness of 0.8 μm thereon, and fluorine-moistening plating with Ni—P—PTFE particles is carried out to form a protective layer having a thickness of 1.5 μm. The coercive force of the magnetic recording layer is 400 Oe, and the remanent flux density is 7000 G. The contact angle of purified water to the surface of the magnetic drum 10 at 25° C. and 50% R H is 110°.

As the magnetic head 12, a 4-channel full-line magnetic head for forming pixels corresponding to 600 dpi (dpi: number of dots per inch) consisting of Mn—Zn ferrite is prepared.

The developing unit 14 includes, as a developing roller 14*a*, a magnetic roll having a cylindrical permanent magnetic arranged concentrically in an aluminum nonmagnetic sleeve, and a stirring blade is arranged to stir the liquid developer in the developer storing container 14*b*. The liquid developer described above is introduced into the developer storing container 14*b*, and the developing unit 14 is arranged such that the gap between the surface of the nonmagnetic sleeve and the surface of the magnetic drum 10 reaches 50 μm.

The intermediate transfer body 16 has a silicone rubber layer of 7.5 mm in thickness thereon and uses an aluminum intermediate transfer drum rotating together with the magnetic drum 10 at the same circumferential velocity.

As the transfer fixing roller 28, an elastic roll having a silicone rubber layer and a fluorine rubber layer arranged in this order on the outer periphery of a stainless steel core material, and this elastic roll is constituted such that the surface temperature thereof is variably heated with a heating element.

The printing conditions of the image forming apparatus 100 thus constituted are established as follows:

- •Magnetic drum linear velocity: 100 mm/sec
- •Developing roller circumferential velocity/magnetic drum circumferential velocity ratio: 1.2
- •Transfer condition (intermediate transfer): The suppress strength of the intermediate transfer body against the magnetic drum is set at 1.5 kgf/cm$^2$.
- •Transfer fixing condition: The suppress strength of the intermediate transfer body against the transfer fixing roller is set at 3.0 kgf/cm$^2$.

Under the conditions shown above, a magnetic latent image is formed on the magnetic drum 10 by the magnetic head 12 and then developed by contacting with the liquid developer on the developing roller. Then, the developed toner image is transferred onto the intermediate transfer body 16, then transferred onto recording paper, and fixed under 3 changed conditions of fixing temperature: H·R temperature/P·R temperature, that is, (80° C./50° C.), (100° C./70° C.) and (170° C./140° C.), and those conditions capable of are confirmed. In this exemplary embodiment, H·R temperature means heating roller temperature, and P·R temperature means pressing roller temperature. The results are shown in Table 1.

-Evaluation of Water Resistance of an Image-

The recording paper having an image (patch) formed as described above is dipped for 10 minutes in purified water in a beaker, and then disturbance in the image is confirmed visually. The evaluation criteria are as follows. The results are shown in Table 1.

A: No disturbance in the image is confirmed.

B: Disturbance in the image is confirmed.

Example 2

A liquid developer is obtained by the same method as described in Example 1 except that the amount of calcium carbonate (trade name: LUMINUS, manufactured by Maruo Calcium Co., Ltd.) in the process of (Production of Magnetic Material-Containing Particles) is changed to 20 parts, the number of revolutions of the emulsifying apparatus (trade name: HIGH-FLEX HOMOGENIZER, manufactured by SMT Co., Ltd.) is changed to 6000 rpm, the emulsification time is changed to 3 minutes, and the process of (Preparation of Particle Dispersion Liquid) is changed as follows.

(Preparation of Particle Dispersion Liquid)

93 parts of deionized water is added to 5 parts of the magnetic toner, 1 part (1% by weight) of an acetylene glycol surfactant (trade name: SURFYNOL 465, manufactured by Nissin Chemical Industry Co., Ltd.; chemical structure: polyoxyethylene acetylene glycol ether) and 1 part (1% by weight) of a surfactant (trade name: TRITON X100, manufactured by Wako Pure Chemical Industries, Ltd.), and then the mixture is dispersed under stirring for 3 hours with a ball mill to yield a particle dispersion liquid (liquid developer). (The content of the acetylene glycol surfactant in the particles in a dried state of the particle dispersion liquid from which deionized water was evaporated is 1% by weight)

Example 3

A liquid developer is obtained by the same method as in Example 1 except that the amount of calcium carbonate (trade name: LUMINUS, manufactured by Maruo Calcium Co., Ltd.) in the process of (Production of Magnetic Material-Containing Particles) is changed to 35 parts, the number of revolutions of the emulsifying apparatus (trade name: HIGH-FLEX HOMOGENIZER, manufactured by SMT Co., Ltd.) is changed to 10000 rpm, the emulsification time is changed to 3 minutes, and the process of (Preparation of Particle Dispersion Liquid) is changed as follows.

(Preparation of Particle Dispersion Liquid)

93.5 parts of deionized water is added to 5 parts of the magnetic toner, 0.5 part (0.5% by weight) of an acetylene glycol surfactant (trade name: DYNOL 604, manufactured by Nissin Chemical Industry Co., Ltd.; chemical structure: polyoxyethylene acetylene glycol ether) and 1 part (1% by weight) of a surfactant (trade name: TRITON X100, manufactured by Wako Pure Chemical Industries, Ltd.), and then the mixture is dispersed under stirring for 3 hours with a ball mill to yield a particle dispersion liquid (liquid developer).

(The content of the acetylene glycol surfactant in the particles in a dried state of the particle dispersion liquid from which deionized water was evaporated is 1% by weight)

Example 4

A liquid developer is obtained by the same method as in Example 1 except that the process of (Production of Magnetic Material-Containing Particles) is changed from a suspension polymerization method to a kneading milling method as shown below.

(Production of Magnetic Material-Containing Particles/Kneading Milling Method)

50 parts of the magnetic material particles produced in Example 1, 100 parts of magenta pigment C.I. Pigment Red 185 (manufactured by Clariant (Japan) K. K.) and 850 parts of a styrene-acrylic resin (trade name: ESLEC P-SE-0020, manufactured by Sekisui Chemical Co., Ltd.) are added, kneaded with a compression kneader and milled with a collision pulverizing jet mill (trade name: AFG, manufactured by Hosokawa Micron Group), followed by cutting off coarse and fine powders with an air classifier (Elbow Jet), to give magnetic material-containing particles (magnetic toner).

Comparative Example 1

A liquid developer is obtained by the same method as in Example 1 except that the process of (Preparation of Particle Dispersion Liquid) is changed as follows.

(Preparation of Particle Dispersion Liquid)

94 parts of deionized water is added to 5 parts of the magnetic toner and 1 part (1% by weight) of a surfactant (trade name: TRITON X100, manufactured by Wako Pure Chemical Industries, Ltd.), and then the mixture is dispersed under stirring for 3 hours with a ball mill to yield a particle dispersion liquid (liquid developer).

Comparative Example 2

A liquid developer is obtained by the same method as in Comparative Example 1 except that the resin used in the process of (Production of Magnetic Material Particles) is changed form the styrene-acrylic resin to a styrene resin as shown below.

(Production of Magnetic Material-Containing Particles Use of Styrene Resin)

74 parts of styrene monomer (manufactured by Wako Pure Chemical Industries Ltd.) is mixed with 11 parts of a styrene-acrylic resin (trade name: ESLEC P-SE-0020, manufactured by Sekisui Chemical Co., Ltd.), and then 4.3 parts of the magnetic material particles prepared in Example 1 and 10 parts of magenta pigment C.I. Pigment Red 185 (manufactured by Clariant (Japan) K. K.) are added to the mixture and dispersed for 24 hours with a ball mill. 5 parts of azobisisobutyronitrile (manufactured by Wako Pure Chemical Industries Ltd.) is added as a polymerization initiator to 90 parts of the mixture containing the magnetic material, thereby preparing a mixture containing the monomer, the magnetic material particles and the pigment.

Magnetic material-containing particles (magnetic toner) are obtained by the same method as in Example 1 except that this mixture is used.

Comparative Example 3

A liquid developer is obtained by the same method as in Example 1 except that the process of (Preparation of Particle Dispersion Liquid) is changed as follows, (Preparation of Particle Dispersion Liquid)

93 parts of deionized water is added to 5 parts of the magnetic toner, 1 part (1% by weight) of an acetylene glycol surfactant (trade name: SURFYNOL 465, manufactured by Nissin Chemical Industry Co., Ltd.; chemical structure: polyoxyethylene acetylene glycol ether) and 1 part (1% by weight) of a surfactant (trade name: DEMOL EP, manufactured by Kao Corporation), and then the mixture is dispersed under stirring for 3 hours with a ball mill to yield a particle dispersion liquid (liquid developer).

(The content of the acetylene glycol surfactant in the particles in a dried state of the particle dispersion liquid from which deionized water was evaporated is 1% by weight)

Comparative Example 4

A liquid developer is obtained by the same method as in Example 1 except that the process of (Preparation of Particle Dispersion Liquid) is changed as follows.

(Preparation of Particle Dispersion Liquid)

95 parts of deionized water is added to 5 parts of the magnetic toner and 0.05 part (0.05% by weight) of an acetylene glycol surfactant (trade name: Surfynol 465, manufactured by Nissin Chemical Industry Co., Ltd.; chemical structure: polyoxyethylene acetylene glycol ether), and then the mixture is dispersed under stirring for 3 hours with a ball mill to yield a particle dispersion liquid (liquid developer).

(The content of the acetylene glycol surfactant in the particles in a dried state of the particle dispersion liquid from which deionized water was evaporated is 0.06% by weight)

Comparative Example 5

A liquid developer is obtained by the same method as in Example 1 except that the particles produced in the process of (Production of Magnetic Material-Containing Particles) are changed from hydrophobic ones to hydrophilic ones as shown below, and the process of (Preparation of Particle Dispersion Liquid) is changed as follows.

(Production of Magnetic Material-Containing Particles/Production of Hydrophilic Particles)

30 parts of n-butyl methacrylate (manufactured by Wako Pure Chemical Industries Ltd.), 38 parts of a styrene monomer (manufactured by Wako Pure Chemical Industries Ltd.), 6 parts of hydroxyethyl methacrylate and 11 parts of a styrene-acrylic resin (trade name: ESLEC P-SE-0020, manufactured by Sekisui Chemical Co., Ltd.) are mixed with one another. 4.3 parts of the magnetic material particles prepared in Example 1 and 10 parts of magenta pigment C.I. Pigment Red 185 (manufactured by Clariant (Japan) K. K.) are added to the above mixture and dispersed for 24 hours with a ball mill. 5 parts of azobisisobutyronitrile (manufactured by Wako Pure Chemical Industries Ltd.) is added as a polymerization initiator to 90 parts of the mixture containing the magnetic material, thereby preparing a mixture containing the monomer, the magnetic material particles and the pigment.

Magnetic material-containing particles (magnetic toner) are obtained by the same method as in Example 1 except that this mixture is used.

(Preparation of Particle Dispersion Liquid)

85 parts of deionized water is added to 5 parts of the magnetic toner and 10 part (10.0% by weight) of an acetylene glycol surfactant (trade name: SURFYNOL 465, manufactured by Nissin Chemical Industry Co., Ltd.; chemical structure: polyoxyethylene acetylene glycol ether), and then the mixture is dispersed under stirring for 3 hours with a ball mill to yield a particle dispersion liquid (liquid developer).

(The content of the acetylene glycol surfactant in the particles in a dried state of the particle dispersion liquid from which deionized water was evaporated is 7% by weight)

What is claimed is:

1. A particle dispersion liquid comprising:

(meth)acrylic resin-containing hydrophobic particles, an acetylene glycol surfactant adsorbed to the (meth) acrylic resin-containing hydrophobic particles, and water; wherein a particle size of the (meth)acrylic resin-containing hydrophobic particles to which the acetylene glycol surfactant has been adsorbed in a swollen state due to absorbing water until saturation, is about 1.1 to about 2 times as large as the particle size of the (meth)acrylic resin-containing hydrophobic particles in a dried state, and the (meth)acrylic resin is at least one resin selected from a styrene-(meth)acrylic resin or an ethylene-(meth) acrylic resin.

2. The particle dispersion liquid of claim 1, wherein the acetylene glycol surfactant is contained in an amount of about 0.1 to about 5% by weight weight with respect to a total weight of the particle dispersion liquid.

3. The particle dispersion liquid of claim 1, wherein the acetylene glycol surfactant is polyoxyethylene acetylene glycol ether.

4. The particle dispersion liquid of claim 1, wherein the (meth)acrylic resin-containing hydrophobic particles further comprise a pigment.

5. The particle dispersion liquid of claim 4, wherein the pigment is at least one pigment selected from cyan, magenta, yellow, red, green, blue or black pigments.

6. The particle dispersion liquid of claim 1, wherein the (meth)acrylic resin-containing hydrophobic particles further comprise a magnetic material.

TABLE 1

| | Resin Type (Preparation Method) | Particle size in dried state (μm) | Particle size in swollen state (μm) | Ratio of swollen/dried state particle size | Surfactant (content) | Evaluation: Dispersibility | Evaluation: Fixing temperature (H · R/P · R temperature) | Evaluation: Image water resistance |
|---|---|---|---|---|---|---|---|---|
| Example 1 | Styrene-acrylic monomer (suspension) | 3.96 | 4.62 | 1.16 | Surfynol 465 (1%) | excellent | 80/50 Low temperature development is feasible | A |
| Example 2 | Styrene-acrylic monomer (suspension) | 5.85 | 11.7 | 2.0 | TritonX100(1%) Surfynol 465 (1%) | excellent | 80/50 Low temperature development is feasible | A |
| Example 3 | Strene-acrylic monomer (suspension) | 2.40 | 2.65 | 1.1 | TritonX100 (1%) Dynol 604 (0.5%) | excellent | 80/50 Low temperature development is feasible | A |
| Example 4 | Styrene-acrylic monomer (kneading) | 9.00 | 10.8 | 1.11 | Surfynol 465 (1%) | excellent | 80/50 Low temperature development is feasibls | A |
| Comparative Example 1 | Styrene-acrylic monomer | 3.96 | 4.00 | 1.01 | TritonX100 (1%) | excellent | 100/70 High temperature is necessary | A |
| Comparative Example 2 | Styrene monomer | 4.00 | 3.98 | 0.99 | TritonX100 (1%) | slightly bad | 170/140 High temperature is necessary | A |
| Comparative Example 3 | Styrene-acrylic monomer | 3.96 | 4.15 | 1.05 | Demol EP (1%) Surfynol 465 (1%) | excellent | 170/140 High temperature is necessary | A |
| Comparative Example 4 | Styrene-acrylic monomer | 3.96 | 4.00 | 1.01 | Surfynol 465 (0.05%) | slightly bad | 170/140 High temperature is necessary | A |
| Comparative Example 5 | Styrene-acrylic monomer (hydrophilic) | 3.96 | 9.00 | 2.72 | Surfynol 465 (10%) | particle breakage | 80/50 Low temperature development is feasible | B |

7. The particle dispersion liquid of claim 6, wherein the magnetic material is at least one magnetic material selected from magnetite, nickel, yttrium-iron-garnet (YIG), iron powder, g-iron oxide, Ni—Zn ferrite, Mn—Zn ferrite, Cu—Zn ferrite or Li—Zn ferrite.

8. The particle dispersion liquid of claim 7, wherein the magnetic material is YIG, and the magnetization of YIG particles in a 500 Oe magnetic field is about 10 emu/g or more.

9. The particle dispersion liquid of claim 7, wherein the magnetic material is YIG, and the surfaces of YIG particles are hydrophobicized.

10. The particle dispersion liquid of claim 7, wherein the magnetic material is YIG, and the content of YIG particles in the (meth)acrylic resin-containing hydrophobic particles is about 1.4% by weight to about 13% by weight with respect to a total weight of the (meth)acrylic resin-containing hydrophobic particles.

11. The particle dispersion liquid of claim 1, wherein a monomer that is polymerized to configure the (meth)acrylic resin is a (meth)acrylate ester whose alcohol residue is an unsubstituted alkyl group having 1 to 18 carbon atoms.

12. Particles comprising:

(meth)acrylic resin, an acetylene glycol surfactant, and water; wherein a size of the particle in a swollen state due to absorbing water until saturation is about 1.1 to about 2 times as large as the size of the particle in a dried state, and the (meth)acrylic resin is at least one resin selected from a styrene-(meth)acrylic resin or an ethylene-(meth) acrylic resin.

13. The particles of claim 12, wherein the acetylene glycol surfactant is contained in an amount of about 0.01 to about 20% by weight with respect to a total weight of the particles.

14. The particles of claim 12, wherein the acetylene glycol surfactant is polyoxyethylene acetylene glycol ether.

15. The particles of claim 12, wherein the particles further comprise a pigment.

16. The particles of claim 15, wherein the pigment is at least one pigment selected from cyan, magenta, yellow, red, green, blue or black pigments.

17. The particles of claim 12, wherein the particles further comprise a magnetic material.

18. The particles of claim 17, wherein the magnetic material is at least one magnetic material selected from magnetite, nickel, yttrium-iron-garnet (YIG), iron powder, g-iron oxide, Ni—Zn ferrite, Mn—Zn ferrite, Cu—Zn ferrite or Li—Zn ferrite.

19. The particles of claim 12, wherein a monomer that is polymerized to configure the (meth)acrylic resin is a (meth) acrylate ester whose alcohol residue is an unsubstituted alkyl group having 1 to 18 carbon atoms.

* * * * *